US009283618B2

(12) United States Patent
Wu et al.

(10) Patent No.: US 9,283,618 B2
(45) Date of Patent: Mar. 15, 2016

(54) CONDUCTIVE PASTES CONTAINING SILVER CARBOXYLATES

(71) Applicant: XEROX CORPORATION, Norwalk, CT (US)

(72) Inventors: Yiliang Wu, Oakville (CA); Ping Liu, Mississauga (CA)

(73) Assignee: XEROX CORPORATION, Norwalk, CT (US)

( * ) Notice: Subject to any disclaimer, the term of this patent is extended or adjusted under 35 U.S.C. 154(b) by 156 days.

(21) Appl. No.: 13/894,475

(22) Filed: May 15, 2013

(65) Prior Publication Data

US 2014/0342083 A1 Nov. 20, 2014

(51) Int. Cl.

| | |
|---|---|
| ***H01B 1/02*** | (2006.01) |
| ***B22F 1/00*** | (2006.01) |
| ***H01B 1/22*** | (2006.01) |
| ***H01K 1/00*** | (2006.01) |

(52) U.S. Cl.

CPC ..... *B22F 1/0022* (2013.01); *B22F 1/0059* (2013.01); *H01B 1/22* (2013.01); *H01K 1/00* (2013.01); *H01B 1/02* (2013.01)

(58) Field of Classification Search

CPC ..... H01B 1/22; H01B 1/02
USPC ..... 252/514
See application file for complete search history.

(56) References Cited

U.S. PATENT DOCUMENTS

| | | | | |
|---|---|---|---|---|
| 4,404,237 | A * | 9/1983 | Eichelberger et al. | 427/97.5 |
| 4,723,024 | A * | 2/1988 | DePompei | 554/71 |
| 5,093,036 | A * | 3/1992 | Shafe et al. | 252/511 |
| 5,882,722 | A * | 3/1999 | Kydd | 427/98.4 |
| 6,942,825 | B2 | 9/2005 | Honda et al. | |
| 8,057,849 | B2 | 11/2011 | Liu et al. | |
| 8,158,032 | B2 | 4/2012 | Liu et al. | |
| 8,298,314 | B2 | 10/2012 | Li | |
| 8,324,294 | B2 | 12/2012 | Wu et al. | |
| 8,361,350 | B2 | 1/2013 | Wu et al. | |
| 2003/0175411 | A1 * | 9/2003 | Kodas et al. | 427/58 |
| 2010/0239750 | A1 | 9/2010 | Breton et al. | |
| 2011/0135808 | A1 | 6/2011 | Liu et al. | |

OTHER PUBLICATIONS

U.S. Appl. No. 13/894,495, filed May 15, 2013 in the name of Wu et al.

* cited by examiner

*Primary Examiner* — Harold Pyon
*Assistant Examiner* — William Young
(74) *Attorney, Agent, or Firm* — Pillsbury Winthrop Shaw Pittman LLP

(57) ABSTRACT

A paste composition includes a branched metal carboxylate, a solvent in which the branched metal carboxylate is soluble and a gelling agent, wherein the gelling agent is a linear metal carboxylate. The paste solvent may be an aromatic hydrocarbon solvent. The paste compositing may be free of polymeric binder. The paste may be used in forming conductive features on a substrate, including by screen printing or offset printing.

12 Claims, No Drawings

CONDUCTIVE PASTES CONTAINING SILVER CARBOXYLATES

BACKGROUND

Fabrication of electronic circuit elements using liquid deposition techniques is of profound interest as such techniques provide potentially low-cost alternatives to conventional mainstream amorphous silicon technologies for electronic applications such as thin film transistors (TFTs), light-emitting diodes (LEDs), RFID tags, photovoltaics, and the like. However the deposition and/or patterning of functional electrodes, pixel pads, and conductive traces, lines and tracks which meet the conductivity, processing, and cost requirements for practical applications have been a great challenge.

Fabrication of electronic circuit elements using silver paste based on thick film technology, in which the paste is comprised of silver flakes dispersed in polymer binder, is known.

There are drawbacks with the use of silver flakes based on thick film technology. First, as electronic devices become smaller and smaller, high resolution conductive traces are often required. Due to the size of silver flakes (10 to 100 micrometers), high resolution traces (for example of less than 125 micrometers) are very difficult to achieve using the paste. Second, due to the relatively low conductivity of the paste, low resistance is often achieved by depositing a very thick layer (for example of greater than 10 micrometers). As a result, a large amount silver flake material has to be used. As silver prices continue to increase dramatically, the silver pastes with silver flakes become uneconomic.

U.S. Patent Application Publication No. 2011/0135808, incorporated herein by reference in its entirety, describes a method of forming conductive features on a substrate by reacting a metal compound with a reducing agent in the presence of a stabilizer in a reaction mixture comprising the metal compound, the reducing agent, and the stabilizer, wherein the reaction mixture is substantially free of solvent, to form a plurality of metal nanoparticles with molecules of the stabilizer on the surface of the metal nanoparticles. After isolating the plurality of metal nanoparticles, a liquid composition that includes a polymeric binder, a liquid and the plurality of metal nanoparticles with molecules of the stabilizer on the surface of the metal nanoparticles is deposited on a substrate by a liquid deposition technique to form a deposited composition. The deposited composition is then heated to form conductive features on the substrate.

While currently available silver pastes for preparing conductive elements for electronic devices are suitable for their intended purposes, there remains a need for improved pastes capable of forming high resolution traces and having high conductivity, that are desirably also be more economical.

SUMMARY

The above and other issues are addressed by the present application, wherein in embodiments, the application relates to a composition comprising a branched metal carboxylate, a gelling agent, wherein the gelling agent is a linear metal carboxylate, and an aromatic hydrocarbon solvent in which the branched metal carboxylate is soluble, wherein the metal for the linear metal carboxylate and the branched metal carboxylate is selected from the group consisting of silver, palladium and nickel.

In embodiments, the application further relates to a composition comprising a branched silver carboxylate, a gelling or thickening agent, wherein the gelling or thickening agent is a linear metal carboxylate, and a solvent in which the branched silver carboxylate is soluble, and wherein the composition is free of polymer binder and has a viscosity of 1,000 cps or more at room temperature and a shear rate of 1 $s^{-1}$.

In embodiments, the application further relates to a method of forming conductive features on a substrate, comprising providing a composition comprising a branched metal carboxylate, a gelling or thickening agent, wherein the gelling or thickening agent is a linear metal carboxylate, and an aromatic hydrocarbon solvent in which the branched metal carboxylate is soluble, wherein the metal for the linear metal carboxylate and for the branched metal carboxylate is selected from the group consisting of silver, palladium and nickel, depositing the composition onto the substrate, and heating the deposited composition to a temperature from about 80° C. to about 250° C. to form the conductive features on the substrate.

EMBODIMENTS

Described herein is a conductive paste composition that includes both linear metal carboxylates and branched metal carboxylates, along with a solvent in which the carboxylates are soluble. The paste may be used in forming conductive features on a substrate.

Branched metal carboxylates, including branched silver carboxylates, have a good solubility in organic solvents, in particular aromatic hydrocarbon solvents, and thereby can provide sufficient metal content in use. The linear metal carboxylates, including linear silver carboxylates, are gelling agents (also referred to as thickening agents) that act to increase the viscosity of the paste solution, in some cases dramatically, even at very low concentrations in the paste composition. The paste composition herein thus offers numerous advantages over prior conductive paste compositions: 1) high viscosity so that the paste composition can be printed with conventional methods such as screen printing or flexographic printing; 2) no or only a very small amount of metal particles in the paste composition so that the paste composition can be used to print high resolution conductive features such as traces on substrates; and 3) high conductivity so that a thin film formed using the paste can provide sufficiently low resistance.

In this specification and the claims that follow, singular forms such as "a," "an," and "the" include plural forms unless the content clearly dictates otherwise. All ranges disclosed herein include, unless specifically indicated, all endpoints and intermediate values. In addition, reference may be made to a number of terms that shall be defined as follows:

"Optional" or "optionally" refer, for example, to instances in which subsequently described circumstances may or may not occur, and include instances in which the circumstance occurs and instances in which the circumstance does not occur.

The phrases "one or more" and "at least one" refer, for example, to instances in which one of the subsequently described circumstances occurs, and to instances in which more than one of the subsequently described circumstances occurs.

The modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range "from about 2 to about 4" also discloses the range "from 2 to 4."

The paste composition herein thus includes at least one branched metal carboxylate. A carboxylate includes a $COO^-$ group that forms a salt with the metal. By "branched" is intended that the carbon atom chain of the carboxylate is not linear. In a branched metal carboxylate, at least one hydrogen atom or other heteroatom associated with a carbon atom in a linear carbon chain is replaced with a carbon atom or carbon atom chain, thereby creating branching in the chain.

Herein, the branched metal carboxylate desirably has from 6 to about 28 carbon atoms therein, such as from 6 to about 24 or from 6 to about 18 carbon atoms. The carbon atoms may be associated with hydrogen atoms, or one or more of the hydrogen atoms may be replaced with a heteroatom such as sulfur, nitrogen and the like. Branched metal carboxylates with fewer than 6 total carbon atoms may exhibit solubility issues in the solvent, while total carbon atoms exceeding 28 may result in too much organic material being present in the paste, making it difficult to achieve high conductivity unless a very thick portion of paste is used or metal particles are added to the paste.

Examples of suitable carboxylates for the branched metal carboxylate include one or more carboxylates having the above-discussed total number of carbon atoms, such as straight chain carboxylates such as propanoate, butanote, pentanoate, hexanoate, heptanoate, octanoate, nonanoate, decanoate, undecanoate, dodecanoate, tridecanoate, tetradecanoate, pentadecanoate, hexadecanoate, heptadecanoate, octadecanoate, nonadecanoate, icosanoate and the like that are branched via inclusion of one or more alkane side chains such as C1 to C8 branched or linear alkanes. A specific example of a branched metal carboxylate is silver neodecanoate:

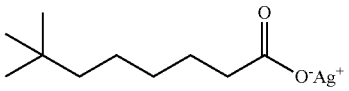

silver neodecanoate

The branched metal carboxylates may be commercially obtained, or may be made by any suitable method. One such suitable method is illustrated in Example 1 herein.

As the metal of the branched metal carboxylate, suitable metals include conductivity imparting metals such as silver, palladium and nickel. The metal may most desirably be silver.

The branched metal carboxylates may comprise about 10% by weight to about 90% by weight of the paste composition, such as from about 25% by weight to about 60% by weight or from about 30% by weight to about 50% by weight of the paste composition. The upper limit on the amount of branched metal carboxylate to include in the paste composition is substantially determined by the solubility of the branched carboxylate in the solvent of the paste composition. The branched metal carboxylate may have a solubility in the organic solvent, in particular an aromatic hydrocarbon solvent, of at least about 10 wt. %, and desirably of no less than about 30 wt. % or no less than about 40 wt. %.

The amount of the branched metal carboxylate is desirably as high as possible so as to permit the paste to have a high conductivity without the need to add additional metal particles to the paste.

The paste composition herein also includes at least one gelling agent, and in particular at least one linear metal carboxylate. By "linear" is intended that the carbon atom chain of the carboxylate is free of branching such as discussed above.

The linear metal carboxylate desirably has from 6 to about 28 carbon atoms therein, such as from 6 to about 24 or from 6 to about 18 carbon atoms. The carbon atoms may be associated with hydrogen atoms, or one or more of the hydrogen atoms may be replaced with a heteroatom such as sulfur, nitrogen and the like.

Examples of suitable carboxylates for the linear metal carboxylate include straight chain carboxylates having the above-discussed total number of carbon atoms, such as hexanoate, heptanoate, octanoate, nonanoate, decanoate, undecanoate, dodecanoate, tridecanoate, tetradecanoate (myristate), pentadecanoate, hexadecanoate (palmitate), heptadecanoate, octadecanoate, nonadecanoate, icosanoate and the like, and combinations thereof. A specific example of a linear metal carboxylate is silver octanoate.

As discussed above, a branched metal carboxylate is desirably included in fairly large amounts in the paste composition. As a result, the composition has a very low viscosity of around a few centipoise (cps). The viscosity of the composition can surprisingly be increased with the inclusion of small amounts of the linear metal carboxylate gelling or thickening agent. For example, with only 0.5% by weight addition of silver octanoate to a paste of silver neodecanoate, the viscosity, measured at room temperature at a shear rate of 1 $s^{-1}$, may be increased dramatically to over 10,000 cps. In embodiments, the composition with the gelling agent therein has a viscosity, as measured at room temperature and a shear rate of 1 $s^{-1}$, of 1,000 cps or more, such as 5,000 cps or more. As a result, the paste can be printed with screen printing and/or offset printing to achieve a conductive feature exhibiting high conductivity, for example of 10,000 S/cm (Siemens/cm) or more, following curing. This is in contrast to thick film technology or other paste formulations that use polymeric additives to increase viscosity. Herein, only a very small amount of linear metal carboxylate is needed to achieve high viscosity. Also, unlike polymer binders or additives which cannot be burned off at low temperature, linear metal carboxylate can be decomposed into pure metal upon thermal annealing, and as a result, there is no insulating component in the final annealed film, and thus higher conductivity.

While in embodiments a polymer binder may be included in the paste composition, in other embodiments the paste composition is entirely free of all polymer binders and other additives, such as low-polarity additives such as described in U.S. Patent Application Publication No. 2010/0239750, incorporated herein by reference in its entirety, that impart insulating properties in the annealed paste. If a polymer binder or additive is included, it may be present in the paste composition in an amount of from about 0.1% by weight to about 3% by weight of the paste composition.

The linear metal carboxylates may be commercially obtained, or may be made by any suitable method. One such suitable method is illustrated in Example 2 herein.

As the metal of the linear metal carboxylate, suitable metals include conductivity imparting metals such as silver, palladium and nickel. The metal for the branched metal carboxylate may be the same as or different from the metal for the linear metal carboxylate. The metal may desirably be silver for both the branched metal carboxylate and for the linear metal carboxylate.

The linear metal carboxylates may comprise about 0.01% by weight to about 5% by weight of the paste composition, such as from about 0.01% by weight to about 3% by weight or from about 0.01% by weight to about 2% by weight of the paste composition. The greater the amount of linear metal carboxylate added, the greater the viscosity increase realized in the paste composition.

The weight ratio of the branched metal carboxylate to the linear metal carboxylate may be from about 10:1 to about 1000:1, such as from about 10:1 to about 500:1 or from about 10:1 to about 600:1.

The desired viscosity of the paste composition depends on the method to be used in applying the paste composition to a substrate to form a conductive feature thereon. For example, for screen or offset printing applications, the paste composition may have a viscosity of from about 5,000 to about 35,000 cps. For application by flexographic printing, the paste composition may have a lower viscosity, for example of from about 100 to about 5,000 cps. One of ordinary skill in the art can readily determine an appropriate viscosity for a desired application technique, and thereby appropriately dial in the viscosity of the paste through control of the amount of linear metal carboxylate included in the paste composition.

The paste composition also includes a solvent. Any solvent in which the branched metal carboxylates are soluble may be used. In embodiments, the solvent is an organic solvent, and desirably may be an aromatic hydrocarbon solvent, for example such as toluene, xylene, trimethylbenzene, ethyl benzene, diethyl benzene, propyl benzene, methyl propyl benzene, butyl benzene, tetrahydronaphthalene, methylnaphthalene, cumene and combinations thereof.

The solvent may comprise from about 10% by weight to about 90% by weight of the paste composition, such as from about 10% by weight to about 75% by weight or from about 10% by weight to about 50% by weight of the paste composition.

The paste composition may contain only the branched metal carboxylate, the linear metal carboxylate and the solvent. While the paste may optionally include metal particles, such as metal nanoparticles such as silver nanoparticles, the paste composition in embodiments may be free of metal nanoparticles so as to be able to form high resolution conductive features on a substrate, and is desirably free of larger metal particles.

The term "nano" as used, for example, in "silver nanoparticles" refers to, for example, a particle size of less than about 1,000 nm, such as, for example, from about 0.5 nm to about 1,000 nm, for example, from about 1 nm to about 500 nm, from about 1 nm to about 100 nm, from about 1 nm to about 25 nm or from about 1 to about 10 nm. The particle size refers to the average diameter of the metal particles, as determined by TEM (transmission electron microscopy) or other suitable method.

If necessary or desired to include metal nanoparticles such as silver nanoparticles in the paste composition, the metal nanoparticles may be present in an amount of about 1 to about 30% by weight of the paste composition, or from about 5 to about 25% by weight of the paste composition. Metal nanoparticles may be needed in the paste composition where the metal carboxylates alone do not provide sufficient metal content to achieve the desired conductivity in the end conductive features. The metal nanoparticles increase the conductivity of the end conductive features, but at the expense of requiring a thicker film with potentially decreased resolution. The conductivity of the end conductive features formed using the paste composition varies depending upon the desired use, but may be at least, for example, 10,000 S/cm.

The paste composition may be formed using any suitable mixing technique, and the branched and linear metal carboxylates may be introduced into the solvent in any order or simultaneously. If advantageous or necessary, the branched metal carboxylate and linear metal carboxylate may each be dissolved in solvents separately, which solvents may be the same or different, and then mixed. In embodiments, the branched metal carboxylate may be added to the solvent, and the mixture heated, stirred, and/or sonicated until the branched metal carboxylate dissolves. The linear metal carboxylate may then be added into the solution, and the mixture again subjected to heating, stirring, and/or sonication. The resulting composition may then be cooled to room temperature where necessary, thereby obtaining the paste.

The paste compositions herein may be used to form conductive features on a substrate, for example in methods comprising providing the paste composition, depositing the composition onto the substrate, and heating the deposited composition to a temperature from about 80° C. to about 250° C. to form (for example, by annealing) the conductive features on the substrate. The depositing may be achieved by any number of techniques such as, for example, spin coating, blade coating, rod coating, dip coating, lithography or offset printing, gravure, flexography, screen printing, stencil printing and stamping.

In embodiments, the fabrication of an electrically conductive element from the metal nanoparticle dispersion can be carried out by depositing the composition on a substrate using any suitable deposition technique at any suitable time prior to or subsequent to the formation of other optional layer or layers on the substrate. Thus, deposition of the composition on the substrate can occur either on a substrate or on a substrate already containing layered material, for example, a semiconductor layer and/or an insulating layer.

The phrase "deposition technique" refers to, for example, deposition of a composition using a process such as coating or printing. Examples of coating processes may include, for example, spin coating, blade coating, rod coating, dip coating, and the like. Examples of printing techniques may include, for example, lithography or offset printing, gravure, flexography, screen printing, stencil printing, stamping (such as microcontact printing), and the like, with flexography being the desired printing technique. Deposition deposits a layer of the composition having a thickness ranging from about 5 nanometers to about 5 millimeters, such as from about 10 nanometers to about 1,000 micrometers. The paste compositions herein may form high resolution traces, for example of less than 125 micrometers thickness. The deposited composition at this stage may or may not exhibit appreciable electrical conductivity.

The substrate upon which the metal features are printed may be any suitable substrate, including, for example, silicon, glass plate, plastic film, sheet, fabric, or paper. For structurally flexible devices, plastic substrates, such as for example polyester, polycarbonate, polyimide sheets and the like may be used. The thickness of the substrate may be from amount 10 micrometers to over 10 millimeters with an exemplary thickness being from about 50 micrometers to about 2 millimeters, especially for a flexible plastic substrate and from about 0.4 to about 10 millimeters for a rigid substrate such as glass or silicon.

Heating the deposited composition at a temperature of, for example, at or below about 250° C., such as, for example, from about 80° C. to about 200° C., from about 100° C. to about 180° C., from about 120° C. to about 160° C. and from about 130° C. to about 150° C., "anneals" the paste and forms an electrically conductive layer, which is suitable for use as an electrically conductive element in electronic devices. The heating temperature is one that does not cause adverse changes in the properties of previously deposited layer(s) or the substrate (whether single layer substrate or multilayer substrate). Also, the low heating temperatures described above allows the use of low cost plastic substrates, which have an annealing temperature below 200° C.

The heating can be performed for a time ranging from, for example, 1 second to about 10 hours and from about 10 seconds to 1 hour. The heating can be performed in air, in an inert atmosphere, for example, under nitrogen or argon, or in a reducing atmosphere, for example, under nitrogen containing from 1 to about 20 percent by volume hydrogen. The heating can also be performed under normal atmospheric pressure or at a reduced pressure of, for example, from about 1000 mbars to about 0.01 mbars.

As used herein, the term "heating" encompasses any technique(s) that can impart sufficient energy to the heated material or substrate to reduce the metal carboxylates, anneal any metal nanoparticles, and remove any remaining solvent. Examples of heating techniques may include, for example, thermal heating (for example, a hot plate, an oven, and a burner), infra-red ("IR") radiation, a laser beam, microwave radiation, or UV radiation, or a combination thereof.

Prior to heating, the layer of the deposited paste may be electrically insulating or with very low electrical conductivity, but heating results in an electrically conductive layer.

The resulting elements can be used as electrodes, conductive pads, thin-film transistors, conductive lines, conductive tracks, and the like in electronic devices such as thin film transistors, organic light emitting diodes, RFID (radio frequency identification) tags, photovoltaic, printed antenna and other electronic devices which require conductive elements or components.

The embodiments disclosed herein will now be described in detail with respect to specific exemplary embodiments thereof, it being understood that these examples are intended to be illustrative only and the embodiments disclosed herein is not intended to be limited to the materials, conditions, or process parameters recited herein. All percentages and parts are by weight unless otherwise indicated. Room temperature refers to a temperature ranging for example from about 20 to about 25° C.

Example 1

Preparation of Branched Silver Carboxylate

Silver neodecanoate, a branched metal carboxylate, was prepared as follows.

22.5 g (0.13 mole) gram neodecanoic acid was added into 30 ml toluene. 10 gram (0.043 mole) silver oxide ($Ag_2O$) powder was added slowly into the mixture, and stirred at room temperature for 60 min. The black silver oxide was dissolved to form a brown solution. 100 ml methanol was added to the reaction mixture to precipitate the silver neodecanoate. White to light brown silver salt was collected and dried for use in paste formulation.

Example 2

Preparation of Linear Silver Carboxylate

Silver octanoate, a linear metal carboxylate, was prepared as follows.

2 gram octanoic acid was added into 10 ml toluene. 1.0 gram (0.0043 mole) silver oxide ($Ag_2O$) powder was added slowly into the mixture, and stirred at room temperature for 60 min. The black silver oxide was dissolved, and the whole mixture became off-white paste. 100 ml methanol was added to the reaction mixture to precipitate the silver octanoate. White powder was collected and dried for use in paste formulation.

Example 3

Paste Formulation and Viscosity Measurement 5 grams of silver neodecanoate powder from Example 1 was added into 4.95 gram trimethylbenzene solvent. The mixture was heated, stirred, and/or sonicated until the branched silver carboxylate salt was dissolved, yielding a low viscosity solution. This solution formed a comparative example. 0.05 grams of silver octanoate from Example 2 was then added into a solution identical to the comparative example, and heated/sonicated to dissolve the linear silver carboxylate salt. Upon cooling down to room temperature, a paste was obtained. The viscosity of the paste, and the branched silver neodecanoate solution, was measured.

The solution containing the branched silver neodecanoate only showed a very low viscosity less than 10 cps. On the other hand, the paste with the branched silver neodecanoate and the small amount of linear silver octanoate showed a viscosity up to $10^7$ cps at low shear rate, which is a viscosity typically used with materials for analog printing such as screen printing.

Example 4

Conductivity Measurement

The solution containing silver neodecanoate only was spin coated on a glass slide, and the paste with both linear and branch silver salts was painted on a glass slide. The films were thermally annealed on a hot plate at 140° C. for 20 min, yielding silver films. The conductivity was measured using a 4-probe technique. Both films showed conductivity of 2.2-$3.0\times10^4$ S/cm. This confirms that the addition of the linear metal carboxylate gelling agent permits the viscosity of the composition to be adjusted for uses requiring higher viscosity without negatively impacting the conductivity of the end product formed using the composition.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A composition for screen printing or flexographic printing comprising a branched metal carboxylate, an aromatic hydrocarbon solvent in which the branched metal carboxylate is soluble, a thickening agent, wherein the thickening agent is a linear metal carboxylate, and silver nanoparticles, wherein the metal for the linear metal carboxylate and for the branched metal carboxylate is silver and further wherein the composition has a viscosity of 5,000 cps or more at room temperature and a shear rate of 1 $s^{-1}$;

wherein the composition contains about 10% by weight to about 90% by weight of the composition of the branched metal carboxylate, about 0.01% by weight to about 5% by weight of the composition of the linear metal carboxylate, and wherein a weight ratio of the branched metal carboxylate to the linear metal carboxylate is from about 10:1 to about 1000:1.

2. The composition of claim 1, wherein the linear silver carboxylate comprises a C6 to C28 linear carboxylate chain.

3. The composition of claim 1, wherein the linear silver carboxylate is selected from the group consisting of silver hexanoate, silver octanoate, silver decanoate, silver dodecanoate, silver myristate, silver palmitate, and combinations thereof.

4. The composition of claim 1, wherein the branched silver carboxylate comprises a C6 to C28 branched carboxylate chain.

5. The composition of claim 1, wherein the branched silver carboxylate is silver neodecanoate.

6. The composition of claim 1, wherein the aromatic hydrocarbon solvent is selected from the group consisting of toluene, xylene, trimethylbenzene, ethylbenzene, diethylbenzene, tetrahydronaphthalene, methylnaphthalene, propylbenzene, methyl propylbenzene, ethyl propylbenzene, butylbenzene, cumene, and combinations thereof and combinations thereof.

7. A composition for screen printing or flexographic printing comprising a branched silver carboxylate, a solvent in which the branched silver carboxylate is soluble, a thickening agent, wherein the thickening agent is a linear silver carboxylate, and silver nanoparticles, wherein the composition has a viscosity 1,000 cps or more at room temperature and a shear rate of 1 $s^{-1}$, and is free of polymer binder;

wherein the composition contains about 10% by weight to about 90% by weight of the composition of the branched silver carboxylate, about 0.01% by weight to about 5% by weight of the composition of the linear silver carboxylate, and wherein a weight ratio of the branched silver carboxylate to the linear silver carboxylate is from about 10:1 to about 1000:1.

8. The composition of claim 7, wherein the linear silver carboxylate is selected from the group consisting of silver hexanoate, silver octanoate, silver decanoate, silver dodecanoate, silver myristate, silver palmitate, and combinations thereof.

9. The composition of claim 7, wherein the branched silver carboxylate is silver neodecanoate.

10. The composition of claim 7, wherein the aromatic hydrocarbon solvent is selected from the group consisting of toluene, xylene, trimethylbenzene, ethylbenzene, diethylbenzene, tetrahydronaphthalene, methylnaphthalene, propylbenzene, methyl propylbenzene, ethyl propylbenzene, butylbenzene, cumene, and combinations thereof.

11. A method of forming conductive features on a substrate, comprising:

providing the composition of claim 1, depositing the composition onto the substrate, and heating the deposited composition to a temperature of about 80° C. to about 250° C. to form the conductive features on the substrate.

12. The method of claim 11, wherein the step of depositing is selected from the group consisting of flexographic printing and screen printing.

* * * * *